United States Patent [19]

Iida

[11] 4,221,022

[45] Sep. 9, 1980

[54] APPARATUS FOR STRIPPING THE CARDED WEB FROM THE DOFFER CYLINDER OF THE TEXTILE CARDING MACHINE

[75] Inventor: Shigenobu Iida, Nagoya, Japan

[73] Assignee: Howa Kogyo Kabushiki Kaisha, Aichi, Japan

[21] Appl. No.: 28,187

[22] Filed: Apr. 9, 1979

[30] Foreign Application Priority Data

Apr. 7, 1978 [JP] Japan ..... 53-41483

[51] Int. Cl.[2] ..... D01G 15/46; D01G 15/50; D01G 15/84

[52] U.S. Cl. ..... 19/106 R; 19/114

[58] Field of Search ..... 19/97, 106 R, 112, 114, 19/150

[56] References Cited

U.S. PATENT DOCUMENTS

| | | | |
|---|---|---|---|
| 2,115,605 | 4/1938 | Allen et al. | 19/112 |
| 2,937,413 | 5/1960 | Hollingsworth | 19/114 |
| 3,725,975 | 4/1973 | Varga et al. | 19/106 R |
| 3,824,650 | 7/1974 | Watanabe | 19/106 R |
| 3,833,968 | 9/1974 | Arai | 19/114 |
| 4,099,295 | 7/1978 | Pickles | 19/106 R |

FOREIGN PATENT DOCUMENTS

| | | | |
|---|---|---|---|
| 2364262 | 6/1975 | Fed. Rep. of Germany | 19/106 R |

*Primary Examiner*—Louis Rimrodt

*Attorney, Agent, or Firm*—Armstrong, Nikaido, Marmelstein & Kubovcik

[57] ABSTRACT

An apparatus for stripping a carded web from a doffer cylinder of a textile carding machine comprises a roller arrangement which consists of a card clothed doffer cylinder, a stripping roller clothed with a scatteredly toothed metallic wire, a pair of top and bottom rollers arranged successively to the stripping roller, and an auxiliary stripping roller clothed with a scatteredly toothed metallic wire disposed close to the stripping roller and above the top roller, wherein the top and bottom rollers rotate at the same surface speed as that of the stripping roller, while the surface speed of the auxiliary stripping roller is lower than that of the stripping roller; the top roller, stripping roller and the auxiliary stripping roller rotate in the same direction; and furthermore, the distance between the bottom roller and the stripping roller and the distance between the top roller and the stripping roller are both narrow.

9 Claims, 10 Drawing Figures

APPARATUS FOR STRIPPING THE CARDED WEB FROM THE DOFFER CYLINDER OF THE TEXTILE CARDING MACHINE

The present invention relates to an apparatus for stripping a carded web from a doffer cylinder of a textile carding machine and more specifically relates to a roller having a combination of a stripping roller clothed with a special metallic wire such as scatteredly toothed metallic wire having teeth of a non-sawtooth configuration and a pair of rollers each exhibiting a smooth surface, so that a web transported from the card clothing of the doffer cylinder to the card clothing of the stripping roller can be delivered from this apparatus in such a manner that the fiber distribution within the delivered web from this apparatus is maintained without being changed from that of the fibers within the web held on the stripping roller. Furthermore, by providing an auxiliary stripping roller in the region above the pair of rollers, an operation of threading the web can be automatically carried out without utilizing any manual steps when the carding machine commences its carding operation.

There are several kinds of roller type doffing apparatus which can be used for doffing and stripping a thin, evenly distributed web or fleece of carded fibers from the surface of doffer cylinder. The web doffed or stripped from the doffer cylinder in the form of a fragile but self-supporting web is then pulled through a trumpet by calender rollers and thereby condensed into a sliver.

An example of such roller type doffing apparatus is disclosed in U.K. Pat. No. 941,843 (U.S. Pat. No. 3,725,975). The roller arrangement of the apparatus of U.K. Pat. No. 941,843 comprises, in combination: a stripper roller which rotates at a surface speed substantially the same as the speed of the doller cylinder and which is disposed in such a manner that the teeth of the stripper roller are located close to but are not engaged with the teeth of the doller cylinder; means for detaching the fibers from the stripper roller, such means comprising a pair of rollers, one of which is a bare roller being arranged close to the teeth of the stripper roller for transporting a web from the stripper roller to the bare surface roller; and means for rotating the bare roller in the same direction as that of the stripper roller but at a surface speed greater than that of the stripper roller, so that the web running from the stripper roller to the pair of rollers is subjected to a drafting action.

In this apparatus such drafting action is indispensable for separating the web from the stripper roller, because the web is held rather firmly on the card clothing (such as is made from flexible wire or metallic wire) of the stripper roller. In addition to this, when threading the web between a pair of rollers, if the bare roller initially fails to peel the web from the card-clothed stripper roller, a slight wetting of the surface of the bare roller is ordinarily sufficient to start the peeling action for carrying out the threading step. However, a manual operation is required for wetting the surface of the bare roller.

By this roller arrangement, it is impossible to deliver a web from the roller type doffing apparatus in such a way that its fiber distribution is maintained without being changed from that of the web held on the surface of the stripper roller. Furthermore, a completely automated operation of threading the web between the pair of rollers cannot be obtained by using this apparatus.

Another apparatus is disclosed in U.K. Pat. No. 1,067,526. In the roller arrangement of this apparatus, the bottom roller of a pair of rollers in so arranged that the roller is disposed in close proximity to the lower surface of the stripper (or intermediate) roller, so that the card-web can be pulled from the stripper roller. Furthermore, in this apparatus the upper roller corresponding to that of the apparatus of U.K. Pat. No. 941,843 is replaced with a roller having a plurality of longitudinal grooves, wherein the sharp edges of the grooves are pointing in the direction of the circumferential movement of the upper roller, and means are provided for rotating the upper roller and the lower roller in such a way that the circumferential speed of the upper roller is slower than the circumferential speeds of the stripper roller and of the lower roller, while the circumferential speed of the lower roller is greater than the circumferential speed of the stripper roller. By means of the edges of the grooves of the upper roller, the card-web on the stripper roller can be seized and pulled from the stripper roller when threading of the web between the upper and lower rollers is carried out.

By the pulling action of the upper and lower rollers of this apparatus, the card-web on the stripper roller clothed with rigid sawteeth can be pulled from the stripping roller by means of the nip formed by the upper and lower rollers. As a result, the arrangement of the fibers within the delivered web is not substantially the same as that of the fibers within the web being held on the surface of the stripper roller. It should be emphasized that the above-mentioned pulling action is indispensable to the invention of U.K. Pat. No. 1,067,526. However, the apparatus of this invention still has the disadvantage in that a completely automatic threading operation cannot be obtained. If a web of dirty cotton is processed through this apparatus, one drawback exists, i.e., some impurities such as a leaf or foreign matter included in the web will accumulate in the grooves of the top roller after this apparatus is operated for a length of time.

The primary object of the present invention is to produce a web delivered from the present roller arrangement in such a manner that the fiber distribution within the delivered web is maintained without being changed from that of the web held on the surface of the stripping roller. This object can be obtained by rotating the lower roller of the roller arrangement at a speed which is substantially the same as that of the stripping roller.

The second object of the present invention is to produce an automatic web threading apparatus for carrying out the operation of threading the web between a pair of top and bottom rollers, by means of the action of an auxiliary stripping roller clothed with a scatteredly toothed metallic wire, which roller is arranged above the top roller and close to the stripping roller clother with a scatteredly toothed metallic wire, wherein the auxiliary stripping roller rotates at a speed lower than that of the stripping roller while the top roller rotates at a speed which is substantially the same as those of the bottom roller and stripping roller, and the top roller is so disposed that a narrow space exists between the top roller and the stripping roller.

The invention will now be more particularly described with reference to the drawings, wherein.

Figure 1:
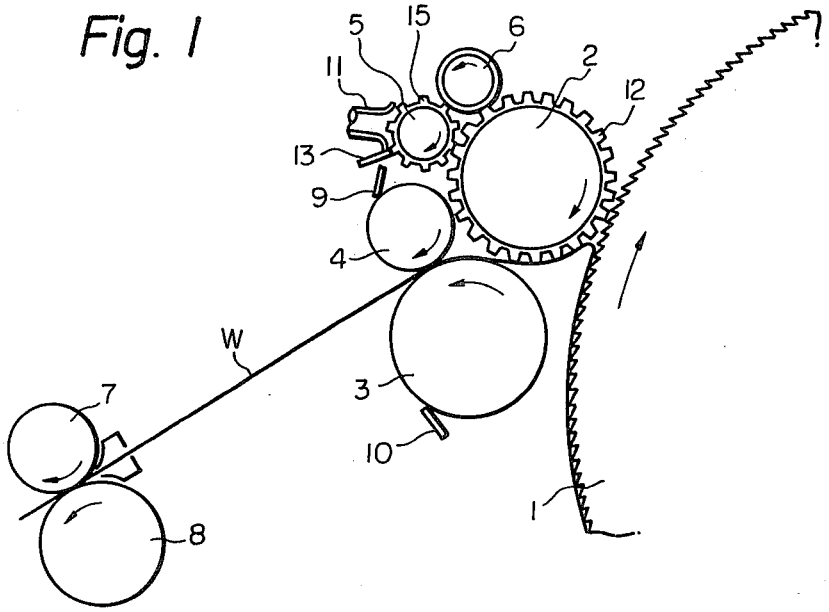
FIG. 1 is a diagrammatic side view of the train of rollers of the present invention.
Figure 2:
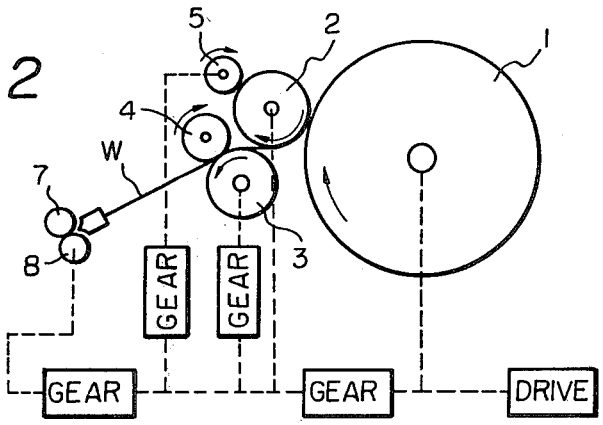
FIG. 2 is a diagrammatic side view of the train of rollers together with the driving train.

Referring first to the roller arrangement shown in FIG. 1, a doffing cylinder 1 and a pair of calender rollers 7 and 8 are rollers which are conventionally used in a textile carding machine. In the drawing, the doffing cylinder 1 rotates in a clockwise direction, and a carded fleece W of fibers placed on the doffing cylinder 1 moves upwardly from under the cylinder. A stripping roller 2 clothed with a scatteredly toothed metallic wire 12 is arranged so as to be close to the doffing cylinder 1, in such a way that the distance between the points of the metallic wire of the doffing cylinder 1 and the points of the scatteredly toothed metallic wire 12 of the stripping roller 2 is 0.1 mm or 0.2 mm. The driving system as shown in FIG. 2 rotates the stripping roller 2 in such a manner that the stripping roller 2 rotates in the same direction as that of the doffing cylinder 1. The surface speed of the stripping roller 2 should be more or less the same as that of the doffing cylinder.

Figure 5:
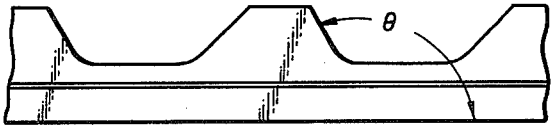
FIG. 5 is an enlarged side view of one embodiment of the scatteredly toothed metallic wire used for the present invention.
Figure 8:
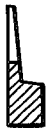
FIG. 8 is a sectional view of the metallic wire shown in FIG. 7.
Figure 7:
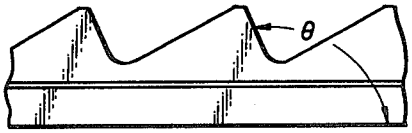
FIG. 7 is a side view similar to that of FIG. 5, showing another embodiment of the metallic wire used for the present invention.
Figure 10:
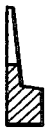
FIG. 10 is a sectional view of the metallic wire shown in FIG. 9.
Figure 9:
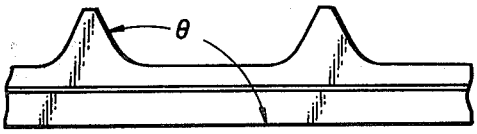
FIG. 9, is a side view similar to that of FIG. 5, showing a still further embodiment of the metallic wire used for the present invention.

As shown in FIGS. 5 through 8, the metallic wire 12 clothed on the stripping roller 2 has teeth of a special non-conventional configuration, i.e., not of a saw-toothed configuration so that the web placed on the points of the wire 12 can be easily removed from the wire by a subsequent roller due to the loose engagement of the web with the points of the wire as shown in FIGS. 5, 7 and 9, the angle (obtuse angle) $\theta$ formed by the fiber-holding flank of a tooth and the lengthwise-direction of the wire is about from 105° to 135°, and a more preferable angle is about from 110° to 125°. The configuration of each of the teeth shown in FIG. 5 is that of a truncated triangle with a flattened top as shown in FIG. 7 or sometimes with a rounded top as shown in FIG. 9. The lengthwise distance between the adjacent teeth of the metallic wire 12, i.e., the pitch, should be as long as 4 to 7 times the pitch of the metallic wire clothed on the doffing cylinder 1.

A pair of rollers 3 and 4 exhibiting a smooth surface is arranged next to the stripping roller 2. The bottom roller 3 should particularly be a roller of a large diameter, and the surface thereof should be arranged below the stripping roller in such a condition that the distance between the smooth surface of the bottom roller 3 to the points of the metallic wire 12 of the stripping roller 2 is about from 2 to 6 mm, preferably from 3 to 4 mm. By this arrangement of the stripping roller 2, the bottom roller 3 and the doffing cylinder 1, a space of a triangular configuration can be defined between the above-mentioned members within the region located under the stripping roller 2. The distance between the bottom roller 3 and the points of wire on the doffing cylinder 1 should preferably be from 15 to 20 mm.

The upper roller 4 exhibiting a smooth surface is arranged above and close to the bottom roller in such a way that the distance between the surfaces of the top and bottom rollers is from 0.1 to 0.2 mm, while the distance between the surface of this top roller 4 and the points of the metallic wire 12 clothed on the stripping roller 2 is from 2 to 10 mm, preferably from 5 to 6 mm, so that the web being held on the metallic wire 12 can be easily released therefrom and separated from the stripping roller by means of an auxiliary shipping roller which will be mentioned hereinafter. Thereafter, the web released from the metallic wire can be caused to adhere onto the surfaces of the top and bottom rollers 3 and 4.

An auxiliary stripping roller 5 clothed with a scatteredly toothed metallic wire 15 is provided in the upper region of the top roller 4. The roller 5 is so arranged that the distance between the points of the metallic wire 15 and the points of the metallic wire 12 of the stripping roller 2 is as narrow as from 0.1 to 0.2 mm, while the distance between the points of the metallic wire 15 of this roller and the surface of the top roller 4 is as narrow as from 5 to 10 mm. Such distance between the auxiliary stripping roller 5 and the top roller 4 should be suitably selected so as to allow an air flow circulating within a region located between the two rollers 4 and 5 to flow out toward the left direction of FIG. 1, from the above-mentioned triangular-shaped space, and so as to prevent such air flow from disturbing the rotation of the auxiliary stripping roller 5 when the top roller 4 is excessively lifted from its normal position, caused by the web being wrapped around the top roller 4 or by an extra thick web passing through the nip of the bottom and top rollers 3 and 4. In the above-mentioned arrangement of the auxiliary stripping roller 5, the bottom roller 3 and the stripping roller 2, the region located between the auxiliary stripping roller 5 and the bottom roller 3 also faces toward the cylindrical surface of the stripping roller 2 which occupies a quarter of the cylinder. Both the top roller 4 and the auxiliary stripping roller 5, rotate in the same direction as that of the stripping roller 2, while the surface speeds of the bottom and top rollers 3 and 4 are substantially the same as those of the stripping roller 2. However, only the surface speed of the auxiliary stripping roller 5 is slower than that of the stripping roller 2, i.e., preferably a surface speed which is 80 percent or less of the speed of the stripping roller 2. A surface speed of from 40 percent to 60 percent of the speed of the stripper roller 2 is especially preferred for this auxiliary stripping roller 5.

The metallic wire 15 clothed on the auxiliary stripping roller 5 may be of a similar configuration as that of the metallic wire 12. However, it is recommended that the obtuse angle $\theta$ formed by the fiber-holding flank of the tooth and the lengthwise direction of the wire of the metallic wire 12 be 5 degrees smaller than that of the metallic wire 12.

As additional equipment, a pneumatic suction nozzle 11 is provided on the left side of the auxiliary stripping roller 5, as shown in FIG. 1. A shutter blade 13 is provided under the suction nozzle 11, so that the suction air stream flowing within the nozzle does not effect any influence upon the triangular space defined by the stripping roller 2, the bottom and top rollers 3 and 4, and the auxiliary stripping roller 5. A clearer roller 6 covered with a clearer cloth is mounted onto both surfaces of both the auxiliary stripping roller 5 and the stripping roller 2. The clearer roller 6 rotates in accordance with the rotation of both rollers 2 and 5.

For cleaning the surfaces of the bottom and top rollers 3 and 4, a doctor blade 9 is provided close to the roller 4 for cleaning thereof and another doctor blade 10 is also provided close to the roller 3 for cleaning thereof. When the nip of the bottom and top rollers 3 and 4 and the nip of a pair of calender rollers 7 and 8 are so arranged that both nips are situated within one plane, the running web delivered at a high speed from the nip of the bottom and top rollers and then fed to the nip of the calender rollers will not show any wavy movement, and, furthermore the necessary tension to be applied onto the web running between the top and bottom rollers and the pair of calender rollers will be small.

During a normal operation of the carding machine, the apparatus of the present invention operates as follows:

A web to be peeled from the surface of the doffer cylinder 1 by means of the stripping roller 2 and to be carried thereafter along the bottom region of the stripping roller, separates smoothly by itself from the points of the metallic wire 12 of the stripping roller 2 without any pulling force applied thereon due to the special configuration of the tooth of the metallic wire 12, and is then immediately placed onto the surface of the bottom roller 3. Thereafter, the web supported by the bottom roller 3 moves along the peripheral surface of the bottom roller 3 which is rotating at a surface speed exactly the same as that of the stripping roller 2. Consequently, the fiber arrangement or distribution within the web placed on the stripping roller 2 can be maintained without being changed, even for the case where the web has just been delivered from the nip of the bottom and top rollers 3 and 4. As is understood from the above description the primary object of the present invention can be realized by utilizing the roller arrangement according to the invention.

If the above-mentioned metallic wire 12 is replaced by a conventional metallic wire with sawteeth a difficult condition will be caused when the web is separated from the surface of the stripping roller and transferred onto the surface of the bottom roller. Consequently, the selection of a proper configuration for the teeth of the metallic wire 12 is of the utmost importance.

After carrying out a number of tests, the inventor discovered the best configuration for the teeth of the metallic wire, i.e., a configuration which can allow, even when the web is moving at a high speed, the web to be easily peeled from the points of the metallic wire of the doffer cylinder 1 by means of the metallic wire 12 of the stripping roller 2, as well as allow the web to be easily transferred from the stripping roller 2 to the bottom roller 3 without breaking the web, which breakage is caused by a partial portion of the web being separated from the stripping roller and conveyed upwardly together with the points of metallic wire 12 of the stripping roller 2.

The above-mentioned tests were carried out by the inventor under the following conditions.

(a) The configuration of the teeth of the metallic wire 13 was of a truncated triangle as shown in FIG. 5.

(b) The pitch of the metallic wire 12 was 9 mm.

(c) The obtuse angle ($\theta$) formed by the fiber-holding flank of a tooth with the lengthwise direction of the wire was selected to be as 90°, 105°, 110°, 120°, 125°and 135°, during respective tests.

(d) The length of the top of the truncated triangle of the tooth of the metallic wire 12 was 2 mm.

(e) The coiled pitch of the adjacent metallic wire 12 clothed or mounted on the barrel of the stripping roller 2 was 3 mm.

(f) The distance between the stripping roller 2 and the bottom roller 3 was 3 mm.

(g) The distance between the stripping roller 2 and the top roller 4 was 5.8 mm.

(h) The distance between the top roller 4 and the auxiliary stripping roller 5 was 14 mm.

(i) The configuration of the tooth of the metallic wire 15 of the auxiliary stripping roller 5 was that of a truncated triangle as shown in FIG. 5.

(j) The pitch of the metallic wire 15 was 9 mm.

(k) The obtuse angle $\theta$ formed by the fiber-holding flank of a tooth and the lengthwise direction of the wire was 105°.

(l) The length of top of the truncated triangle of the tooth of the metallic wire 15 was 2 mm.

(m) The coiled pitch of the metallic wire 15 mounted on the barrel of the auxiliary stripping roller 5 was 3 mm.

(n) The diametrical dimension of the doffer cylinder was 706 mm.

(o) The surface speed of the stripping roller 2 was 1.3 percent higher than that of the doffer cylinder 1.

(p) The surface speed of the stripping roller 2 and those of the top and bottom rollers 4 and 3 were exactly the same.

(q) The surface speed of the auxiliary stripping roller 5 was 60 percent of the surface speed of the stripping roller 2.

(r) The rotation speed of the doffer cylinder during the threading operation was 8 revolutions per minute.

(s) The rotational speed of the doffer cylinder 1 during the normal operation after completion of the threading of the web was gradually varied from 8 to 50 revolutions per minute.

(t) The materials used were cotton and synthetic fibers.

(u) The staple length of the fiber was 38 mm.

Test result obtained from the tests are as follows:

| Angle $\theta$ in FIGS. 5, 7 and 9 | Reliability of threading operation % | Faulty web stripping | Wrapping | Rolled web |
|---|---|---|---|---|
| 90° | 80% | Did not occur when rotational speed of doffer was below 50 RPM | Occured at 20 RPM | Appeared |
| 105° | 87% | Same as above | Occured at 30 RPM | Appeared |
| 100° | 100% | Same as above | Did not occur below 50 RPM | Did not appeared |
| 115° | 100% | Same as above | Same as above | Same as above |
| 120° | 100% | Same as above | Same as above | Same as above |
| 125° | 100% | Same as above | Same as above | Same as above |
| 135° | 100% | Partially | Same as | Same as |

-continued

| Angle θ in FIGS. 5, 7 and 9 | Reliability of threading operation % | Faulty web stripping | Wrapping | Rolled web |
|---|---|---|---|---|
| | | occured when rotational speed of doffer was 20 RPM | above | above |

From the test results as shown in the above table, it was found that, when a small obtuse angle θ was used, the peeling of the web from the doffer cylinder 1 was reliable, but the separability of the web from the stripping roller 2 was poor. As a result the web was caused to wrap around the stripping roller 2.

Therefore, when the doffer cylinder rotates at a speed of as high as 50 R.P.M., the obtuse angle θ between the fiber-holding flank and the lengthwise direction of the wire of the tooth of the metallic wire 12 clothed on the stripping roller 2 should preferably be maintained within the range of between 110° and 125°. However, when the doffer cylinder rotates at a speed of below 30 P.R.M., obtuse angles θ between 105° and 135° can also be used.

The operation for threading the web between the bottom and top rollers 3 and 4 can be carried out by using the roller arrangement as shown in FIG. 1. The threading sequence of this operation is as follows:

The operation for threading the web between the bottom and top rollers is generally carried out when the carding machine is running at a low speed, such as at a speed of the conventional carding machine. Firstly, the web on the doffer cylinder 1 is peeled off by means of the metallic wire 12 of the stripping roller 2, wherein the obtuse angle θ of the tooth is maintained at either of the above-mentioned two ranges due to penetration of the teeth of the metallic wire 12 into the web on the doffer cylinder 1, and then the web is frictionally held by means of the metallic wire 12.

As the fibers within the web are well entangled, the web transported from the doffer cylinder 1 to the stripping roller 2 enters next into the region in which the auxiliary stripping roller 5 is facing the stripping roller 2 at the closest distance therebetween.

At this region, the web on the stripping roller 2 is successively peeled from the stripping roller 2 by means of the teeth of the metallic wire 15 having an obtuse angle θ, which angle is smaller, by 5° or more, than that of the teeth of the metallic wire 12.

As the rotating speed of the auxiliary stripping roller 5 is 80 percent or less of the speed of the stripping roller 2, or preferably from 40 percent to 60 percent thereof, the leading edge of the web being peeled off can be held by the teeth of the metallic wire 15 of the auxiliary stripping roller 5.

As the surface of the auxiliary stripping roller 5 moves downwardly where said roller is close to the stripping roller 2, the leading edge of the web is stopped from moving upwardly by the point of the wire 15 of the auxiliary stripping roller 5 so that the leading edge is pushed back.

Figure 3:
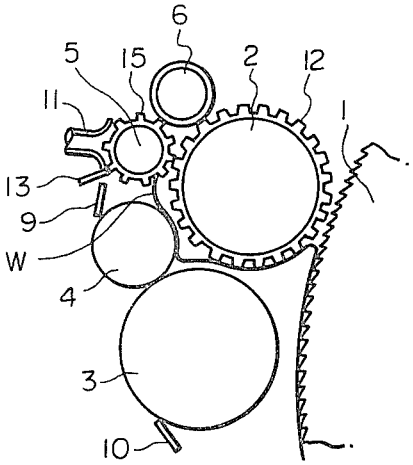
FIG. 3 is a diagrammatic side view of the arrangement of the present invention as shown in FIG. 1, illustrating the initial stage of threading a web.
Figure 4:
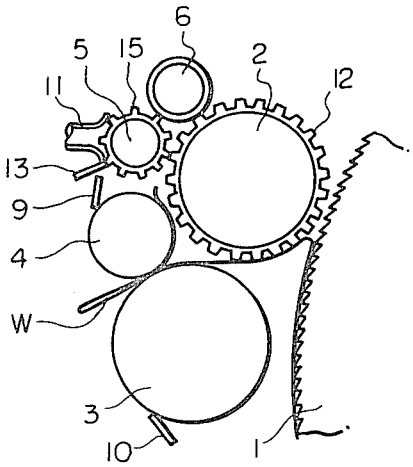
FIG. 4 is a diagrammatic side view similar to FIG. 3, showing the second web threading stage, i.e. the stage where a web is being fed between a pair of rollers.
Figure 6:
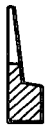
FIG. 6 is a sectional view of the metallic wire shown in FIG. 5.

As a result, the web attains a relaxed condition as shown in FIG. 3. As the auxiliary stripping roller 5 rotates together with the leading edge of the web, the relaxed web W finally comes into contact with the surface of the top roller 4. Thus, the web W contacting on the surface of the top roller 4 is then carried downwardly according to the rotation of the top roller 4, and then the web W is caused to come into contact with the surface of the bottom roller 3. After the web W comes into contact with both surfaces of the top and bottom rollers 4 and 3, the web is folded into a hairpin state by the nip of the top and bottom rollers and finally delivered from the nip toward the left side, as shown in FIG. 4. At this stage, the threading operation is thus completed.

If any part of the web, after being separated from the other part of the processed web, remains on the teeth of the metallic wire 12 due to nonseparation from the teeth, such remaining web part can be removed from the auxiliary stripping roller 5, after being transported from the stripping roller 2 to the auxiliary stripping roller 5, by means of a pnuematic suction generated by the suction nozzle 11.

The distance between the stripping roller 2 and the top roller 4 should be preferably selected to prevent the web engaged with the metallic wire 12 on the stripping roller 2 from being seperated from the wire 12. The results of the tests carried out by the inventor showed that it was not advantageous to thread the web between the top and bottom rollers when the above-mentioned distance was 0.3 mm, that 80% success in threading could be expected when such distance was 2 mm, that 95% success could be expected when such distance was 3 mm, and that 100% success could be obtained when such distance was from 5 to 6 mm.

To increase the reliability of the threading operation, the inventors found that it is preferable to provice a helical groove onto the surface of the top roller 4 to increase the friction between the web W and the surface of the top roller, without disturbing the fundamental function of threading. Such groove may be of 0.8 mm in depth and its helical pitch may be from 80 to 100 mm in length.

As is clear from the above-mentioned disclosure, the surface speed of the auxiliary stripping roller 5 may be preferably selected so that, before the leading edge of the web becomes affected by the suction nozzle 11, the web W is already subjected to the conveying action of the top and bottom rollers 4 and 3. The surfaces of the rollers which come into contact with the web W should preferably be as broad as possible.

According to the results of tests carried out by the inventor, the threading operation could not be successfully carried out when the auxiliary stripping roller 5 rotated at a surface speed of 85 percent of the surface speed of the stripping roller 2 or at the same speed as that of the stripping roller 2. However, when the roller 5 rotated at a surface speed of from 70 to 80% of the surface speed of the roller 2, a successful threading operation could be carried out but a lot of web was disadvantageously sucked into the suction nozzle. The best results were practically obtained when the surface speed was maintained around 40 to 60% of the surface speed of the stripping roller 2.

During the processing of a synthetic fiber which has a long staple length and a good property for engaging with the metallic wire, even when the teeth of the metallic wire 12 were of any one of the configurations shown in FIGS. 5, 7 and 9, a web W consisting of such fibers could not be easily separated from the tips of the teeth of the metallic wire 12, because the web W moved together with the teeth. On the other hand, during the processing of a cotton fiber of a short staple length, the web W sometimes separated from the metallic wire 12 of the stripping roller 2.

However, such separation did not always occur with respect to every kind of cotton. When other kinds of cotton were processed, it was found that the web did not separate from the metallic wire 12 or that the web partially separated from the metallic wire 12.

Generally, in such cases, separation of the web from the metallic wire 12 occurs simultaneously as soon as the web is peeled from the metallic wire of the doffer cylinder 1 by means of the metallic wire 12 of the stripping roller 2. As the doffer cylinder and the stripping roller are rotated continuously, the leading edge of the separated web comes into contact with another part of a successive web held by the metallic wire of the doffer cylinder 1. By the rotation of the doffing cylinder 1 and the stripping roller 2, the leading edge of the separated web is rolled into a mass of web.

When the volume of the rolled mass of web becomes too large, the surface of the rolled mass of web is caused to come into contact with the upper surface of the bottom roller 3. As a result, the rolled mass of web is moved along or carried with the rotating surface of the bottom roller 3, assisted by the stripping roller 2.

Since the rolled mass of web is of a heavy weight, threading of the web through the top and bottom rollers can be automatically effected by the rotation of the bottom roller 3. When such threading is unsuccessful due to the web being forcibly pushed into the teeth of the stripping roller 2, which condition occurs when the rolled mass of web is forcibly passed through the narrow space between the two rollers. After the web is lifted upwardly together with the stripping roller 2, the web is stripped from the stripping roller 2 by the points of the auxiliary stripping roller 5. At this stage, the above-mentioned threading operation by means of the auxiliary stripping roller 5 is carried out for the rolled mass of web. Accordingly, the threading operation can be successfully carried out by using the apparatus of the present invention when separation of the web from the metallic wire 12 occurs over the entire width of the web or over a partial width thereof.

Even in the case where the distance between the doffer cylinder 1 and the bottm roller 3 is as wide as 20 mm, the rolled mass of web is never caused to move downwardly through the space between the doffer cylinder 1 and the bottom roller 3 of the above-mentioned distance, and the rolled mass of web is merely conveyed toward the surface of the bottom roller 3. The distance of 3 to 4 mm between the stripping roller 2 and the bottom roller 3 is practically suitable for easily conveying a large amount of a rolled mass of web.

The web thus delivered from the top and bottom rollers is thereafter converted into a sliver according to the conventional method, after passing through a conventional pair of calender rollers 7 and 8. Only one manual step is necessary in this case. Although the above-described threading operation is carried out when the carding machine is running at a low speed, the speed of the machine can be increased up to its normal high speed after completion of the threading operation. Even while the carding machine is running under a very high speed, a reliable peeling of the web from the doffer cylinder 1, as well as a safe conveyance of the peeled web by means of the bottom roller without causing the web to be wrapped or broken, can be obtained by means of the stripping roller 2. To ensure that such conditions can be reliably obtained, the obtuse angle $\theta$ of the teeth of the metallic wire 12 clothed on the stripping roller 2 must be suitably selected. According to the results of tests carried out by the inventor, as shown in the above table, when the obtuse angle $\theta$ is between 90° and 105°, an undesirable condition, such as an increase in the amount of fibers freed from the web, will occur after the carding machine has been running for a long time even though such fibers can be removed from the wire of the auxiliary stripping roller 5 after the web is conveyed upwardly by the stripping roller 2.

Some freed fibers separated from the web can be stripped by means of the auxiliary stripping roller 5 after the web is conveyed upwardly by means of the stripping roller 2, but sometimes such fibers become a rolled mass of fibers within the region below the auxiliary stripping roller 5 due to the accumulation of fibers in such region defined by the stripping roller 2 and the auxiliary stripping roller 5 when the speed of the auxiliary stripping roller 5 is low.

When the obtuse angle $\theta$ of the teeth of the metallic wire 12 of the stripping roller 2 is as large as 110°, i.e., when such angle is about larger, by 5° or more, than the angle of the teeth of the metallic wire 15 of the auxiliary stripping roller 5, then rolled masses of fibers are not generated.

A similar condition is also brought about when the obtuse angle $\theta$ of the teeth of the metallic wire 12 of the auxiliary stripping roller 5 is between 110° to 125°, the angle $\theta$ of the teeth of the metallic wire 12 of the stripping roller 2 is more than 90°, and the former angle is 5° larger than the latter.

In the present invention, a bottom roller of a large diameter is arranged beneath the stripping roller, so that the web peeled from the doffer cylinder can be conveyed by the surface of the bottom roller in such a way that the distribution of the fibers within the web being peeled off can be maintained without being changed. Therefore, such web is not subjected to any stretching or drafting, and a high quality sliver can be produced from the web delivered from the present apparatus.

The fact that the web peeled from the doffer cylinder is not subjected to any drafting or pulling explains why no breakage of the web will result and why a stable high-speed peeling of the web can be realized by the present apparatus. This is because no web hanging from the surface of the stripping roller or breaking of the web will occur as a result of the short distance between the surfaces of the doffer cylinder 1 and the bottom roller 3.

Furthermore, automatic threading can be reliably carried out in both the case of processing a synthetic fiber and the case of processing a cotton fiber without utilizing any additional manual operation.

The obtuse angle $\theta$ of the teeth of the metallic wire 15 of the auxiliary stripping roller 5 is selected so that it is larger than 90° but smaller, by 5° or more, than that of the teeth of the metallic wire 12 of the stripping roller 2, in order to ensure a reliable peeling of the web from the stripping roller 2.

In addition to this, in the present invention, some freed fibers separated from the web can be removed from the stripping roller 2 by the suction force of the suction nozzle 11 assisted by the auxiliary stripping roller 5. This means that no rolled masses of fiber will be generated, and the any occurrence of wrapped webs or freed fibers on the stripping roller 2 can be prevented. Therefore, the metallic wire of the doffing cylinder will never be damaged at all.

Several modifications of the roller arrangement shown in FIG. 1 can be effected without diverging from the scope of the present invention. One example of such modifications is produced by replacing the large diameter bottom roller of FIG. 1 with a roller of a small diameter. In addition to these changes, a guide plate of a suitable length may be arranged horizontally within the space which is located between the small diameter bottom roller and the doffer cylinder and below the stripping roller 2.

What is claimed is:

1. An apparatus for stripping the carded web from the doffer cylinder of the textile carding machine having a roller arrangement which consists of a card clothed doffer cylinder, a stripping roller and a pair of top and bottom rollers with smooth surfaces arranged one after the other in the direction of a moving web, said roller arrangement comprising in combination:

a stripping roller clothed with a scatteredly toothed metallic wire and arranged close to the doffer cylinder;

a bottom, smooth roller of a large diameter disposed below the stripping roller, wherein the distance between said stripping roller and said bottom roller is such that the surface of said moving web comes into slight contact with the bottom roller, the speed of said bottom roller is substantially the same as that of said stripping roller, and said bottom roller rotates in the opposite direction of that of said stripping roller;

a top smooth roller cooperating with said bottom roller which is disposed in such a way that the distance between said top roller and said stripping roller is small, and said web engaged with said metallic wire of said stripping roller can be released from said stripping roller within said distance, and the surface speed of said top roller is substantially the same as that of said stripping roller, and;

an auxiliary stripping roller clothed with a scatteredly toothed metallic wire and disposed above said top roller and also close to said stripping roller, said auxiliary stripping roller exhibiting a surface speed which is slower than that of said stripping roller and rotating in the same direction as that of said stripping roller.

2. An apparatus as claimed in claim 1, wherein the tooth configuration of said scatteredly toothed metallic wire mounted on said stripping roller exhibits an obtuse angle $\theta$ of from 110° to 125° between the fiber-holding flank of each tooth and the lengthwise direction of said wire.

3. An apparatus as claimed in claim 2, wherein each tooth of said metallic wire mounted on said stripping roller has a configuration of a truncated triangle and the width of the top of said tooth is from 0.2 to 2 mm.

4. An apparatus as claimed in claim 1, wherein the distance between said bottom roller and said stripping roller is from 3 to 4 mm.

5. An apparatus as claimed in claim 1, wherein the distance between said top roller and said stripping roller is from 5 to 6 mm.

6. An apparatus as claimed in claim 1, wherein said auxiliary stripping roller rotates at a surface speed of from 40 to 80 percent of the speed of said stripping roller.

7. An apparatus as claimed in claim 1, wherein the configuration of each tooth of said metallic wire mounted on said auxiliary stripping roller exhibits an obtuse angle $\theta$ of from 90° to 120° between the fiber-holding flank of said tooth and the lengthwise direction of said wire, said angle being smaller, by 5° or more, than the obtuse angle $\theta$ between the fiber-holding flank and the lengthwise direction of the metallic wire mounted on said stripping roller.

8. An apparatus as claimed in claim 7, wherein each tooth of said metallic wire mounted on said auxiliary stripping roller has a configuration of a truncated triangle and the widgth of the top of said tooth is from 0.2 to 2 mm.

9. An apparatus as claimed in claim 1, wherein said auxiliary stripping roller is disposed above said top roller with the distance between said auxiliary stripping roller and said top roller being from 5 to 15 mm.

* * * * *